US005738395A

United States Patent [19]

Probst

[11] Patent Number: 5,738,395

[45] Date of Patent: Apr. 14, 1998

[54] DUMPABLE RUBBISH CONTAINER WITH AUTOMATICALLY RELEASABLE CLOSURE LATCH

[76] Inventor: Evan Probst, 4375 W. 8500 North, Delta, Utah 84624

[21] Appl. No.: 740,495

[22] Filed: Oct. 30, 1996

[51] Int. Cl.[6] ..... E05C 3/06

[52] U.S. Cl. ..... 292/230; 292/DIG. 16; 220/315; 220/908

[58] Field of Search ..... 292/230, 231, 292/235, 194, DIG. 22, 130, 133, DIG. 16, 238, 136; 220/908, 315, 263

[56] References Cited

U.S. PATENT DOCUMENTS

| | | | |
|---|---|---|---|
| 957,796 | 5/1910 | Parmeter | 220/315 |
| 3,033,414 | 5/1962 | Galland | 220/315 |
| 3,618,814 | 11/1971 | Nagroski | 220/46 R |
| 3,844,597 | 10/1974 | Elrod et al. | 292/136 |
| 4,111,476 | 9/1978 | Jocobs | 292/246 |
| 4,520,945 | 6/1985 | Hodge | 220/315 |
| 4,613,174 | 9/1986 | Berg et al. | 292/136 |
| 4,739,896 | 4/1988 | Moss | 220/18 |
| 5,105,967 | 4/1992 | Horpestad | 220/333 |
| 5,149,153 | 9/1992 | Drewry et al. | 292/104 |

FOREIGN PATENT DOCUMENTS

| | | | |
|---|---|---|---|
| 9563000 | 1/1957 | Germany | 220/315 |

*Primary Examiner*—Rodney M. Lindsey
*Attorney, Agent, or Firm*—Mallinckrodt & Mallinckrodt

[57] ABSTRACT

A self-releasing latch arrangement is applied to a conventional rubbish container having hinged lid and being liftable and dumpable by the usual automated garbage truck. The latch arrangement comprises one or more keeper members attached to the container outwardly thereof and overhanging therefrom and at least one heavy latching member swingably suspended from the lid of the container directly above a corresponding keeper member or members for being swung thereinto or therefrom under the influence of gravity. The latching arrangement is effective to secure the container lid closed in high winds and attempted openings by animals pushing on the lid or anything pushing the container over sidewardly or backwardly. The latch automatically releases when the container is tilted toward and into the dumping position, thereby allowing emptying of the contents into the garbage truck. Manual release of the latch to gain access to the container is accomplished by manually swinging the weight away from the keeper.

6 Claims, 2 Drawing Sheets

DUMPABLE RUBBISH CONTAINER WITH AUTOMATICALLY RELEASABLE CLOSURE LATCH

BACKGROUND OF THE INVENTION

1. Field

This invention is in the field of dumpable types of rubbish containers with hinged lids for garbage and other trash.

2. State of the Art

Residential rubbish containers with rearwardly hinged lids are commonly supplied by county, city, or other political subdivision for pick-up and emptying by automated public utility garbage trucks. They are mostly utilized in areas where the amount of rubbish is much less than that of a business or apartment complex. During collection, lift arms of the garbage truck pick up the container and tilt it to dumping position with lid swung open. The contents of the container are thereby emptied into the truck, whereupon the arms of the truck set the container back to its previous, upright standing position.

Large, normally rectangular containers with hinged lids, commonly referred to as "dumpsters" are also emptied by automated garbage trucks. Dumpsters are utilized by business establishments, apartment complexes, etc. for the collection and temporary storage of rubbish and are, therefore, larger than residential containers. However, they are emptied in a similar manner, but different problems must be taken into account.

A dumpster is a voluminous container which attracts unauthorized users to deposit their rubbish therein. Unauthorized use of dumpsters is not easily detected amongst the large number of legitimate users. Prior art solved the unauthorized use problem by attaching a self-disengaging lock between the hinged lid and the body of the dumpster, see U.S. Pat. No. 5,149,153. To load the dumpster, a key is required to release a latch that is provided for securing the dumpster lid. However, when unlocked, the latch is automatically released as the dumpster is tilted into the dumping position.

The smaller, residential rubbish containers have less problems with unauthorized use. The added level of complexity in providing the self-disengaging lock of a dumpster to prevent unauthorized use is therefore unwarranted in the smaller residential type of containers. Moreover, unlike the dumpster, such smaller containers are prone to tipping over or to opening in high wind conditions; also, because their lids are lighter than those of dumpsters, animals have easier access.

Prior art solved the animal problem by utilizing springs to secure the lid to the container, see U.S. Pat. No. 3,618,814. However, the lid is not self-releasing and therefore cannot be used with automated garbage trucks.

SUMMARY OF THE INVENTION

Applicant recognized the need for a dumpable container of either relatively small residential or of large dumpster type with a hinged lid secured by a simple and relatively inexpensive, non-locking latch against opening by high winds or animals while providing ready access to the container by users and that can be dumped by automated dumping trucks.

Accordingly, the principal objective in the making of the present invention was to provide such a dumpable container.

In accordance with the invention, the latch comprises a keeper member mounted on an outer wall of the container and open for receiving, under the influence of gravity, a latching member when the container is upstanding with lid closed. The latching member is hung from the container lid and automatically swings into the open keeper member when the container is in its normal upstanding position, thereby maintaining the container closed and latched, but automatically swings out from such latching condition when the container is tipped toward and into dumping position. Thus, when a container having the self-releasing latch of the invention is tipped toward and into dumping position by an automated dumping device such as carried by present-day garbage trucks, the latching member swings away from the keeper under the influence of gravity and permits the lid to open on its hinged attachment to the container, allowing the container contents to be dumped. The weight of the latching member keeps the container substantially closed and secures the contents therein. However, the lid may be opened manually by simply pulling the latching member away from the keeper. In this way, one may gain access to the interior of the container manually for adding rubbish whenever desired.

This latching arrangement is especially important for the relatively small residential type of container, which is subject to being tipped over by wind or by an animal, but is also advantageous for the larger dumpster type of container.

THE DRAWINGS

The best mode presently contemplated for carrying out the invention is illustrated in the accompanying drawings, in which:

FIG. 1 is a pictorial view showing the front and a side of a typical residential type of rubbish container of the invention standing in closed upright position awaiting pick-up and dumping by a usual automated garbage truck;

FIG. 2, a fragmentary view in front elevation drawn to a considerably larger scale showing the latching mechanism of the container of FIG. 1;

FIG. 3, a view in vertical section taken on the line 3—3 of FIG. 2;

FIG. 4, a view corresponding to that of FIG. 1 but in side elevation and showing the container gripped by the lift arms of an automated garbage truck and tipped toward dumping position with latching mechanism released under the force of gravity from latched condition;

FIG. 5, a view corresponding to that of FIG. 2 but of a different embodiment of latching arrangement;

FIG. 6, a view corresponding to that of FIG. 3 but of the embodiment of FIG. 5 taken on the line 6—6 of FIG. 5 and showing by broken lines the latching member disengaged from its keeper member;

FIG. 7, a fragmentary front elevation of an embodiment of the invention applicable to either a residential or a dumpster-type of rubbish container, but here shown with respect to a dumpster-type, with lid latched closed and an intermediate portion of the container and lid parts broken out for convenience of illustration;

FIG. 8, a view corresponding to that of FIG. 6, but in reverse and on a smaller scale of one of the latching assemblies of the embodiment of FIG. 7 as shown in vertical section taken on the line 8—8 of FIG. 7; and FIG. 9, a fragmentary detail view in horizontal section taken on the line 9—9 of FIG. 8 and drawn to a larger scale.

DETAILED DESCRIPTION OF THE ILLUSTRATED EMBODIMENTS

Figure 1:
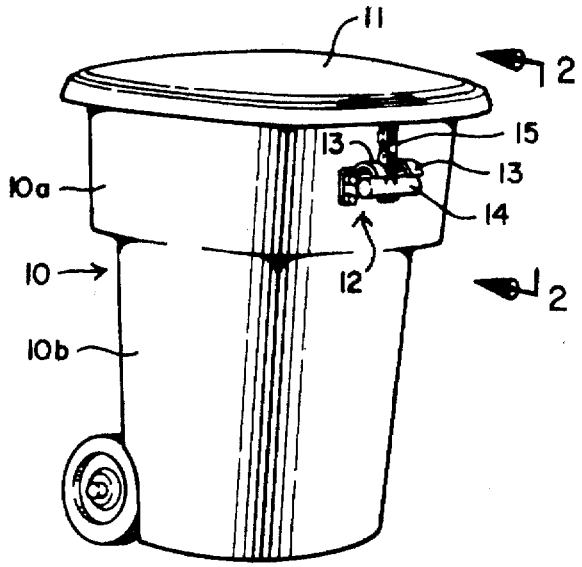
Figure 2:
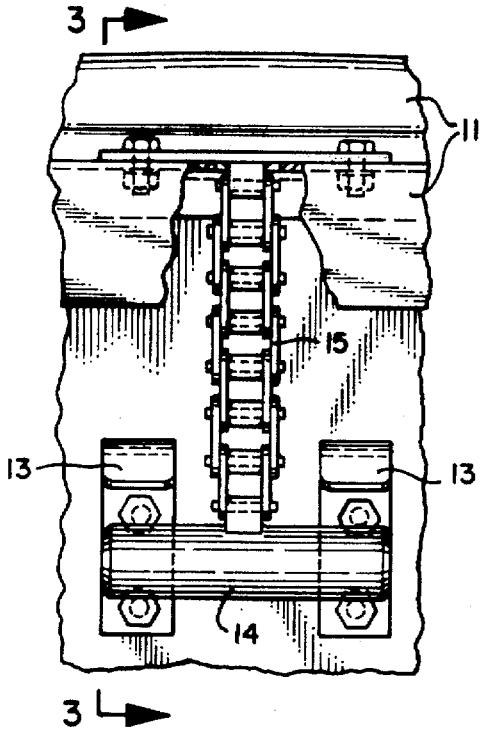
Figure 3:
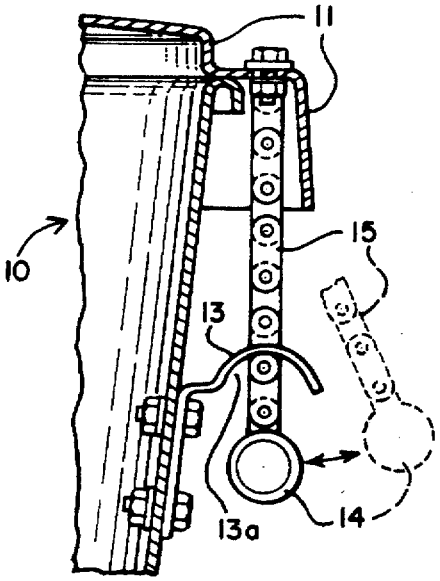
Figure 4:
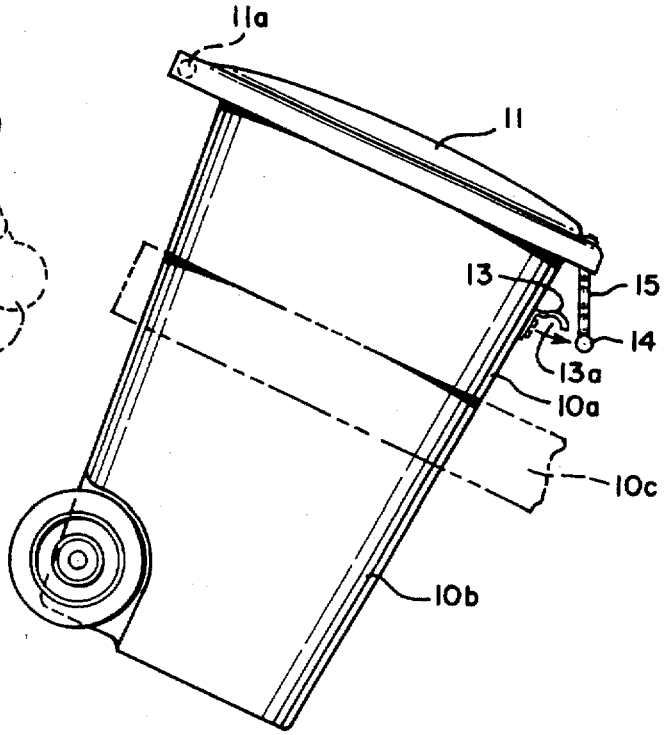

The dumpable rubbish container shown in FIGS. 1–4 is of conventional, relatively small, wheeled, residential type having the rubbish receiving and holding container part 10 made up of a rectangular upper portion 10*a* and a cylindrical lower portion 10*b*. A pair of lift members 10*c*, FIG. 4, of a conventional automated garbage truck (not shown) are received by lower container portion 10*b*, so that, when squeezed together under pressure, the garbage truck can lift and tilt the entire container part 10 forwardly thereof into dumping position in usual manner. A usual overhanging container lid 11 is hingedly attached, as at 11*a*, FIG. 4, to container part 10 rearwardly thereof.

In accordance with the invention, an automatically releasable latching arrangement, 12, is interposed between container part 10 and container lid 11, being made up of at least one keeper member and a cooperative latching member.

In this first embodiment of the invention, there is a pair of keeper members 13 spaced apart from each other and extending approximately horizontally when container part 10 is in its upright, standing position. As shown, each of these keeper members 13 project outwardly and forwardly from securement to the forward, outer wall of upper container portion 10*a*. The keeper members 13 are open at their bottoms and overhang outwardly from the wall to which they are attached. They are recessed upwardly interiorly thereof, as at 13*a*, to receive corresponding end portions of an elongate latching member 14 as a gravity influenced weight for latching cooperation with the keeper members 13. If the container is inadvertently or maliciously pushed over sidewardly or rearwardly or if wind attempts to raise the cover, lid 11 remains closed by reason of the latching arrangement 12.

Latching member 14 is a heavy, elongate bar, normally of iron or steel, suspended from container lid 11 by means of a length 15 of material that is flexible, preferably only or primarily forwardly and backwardly relative to the container and its lid, as for example a length of roller chain, but certainly not restricted thereto. A strap of leather-like material or other relatively inexpensive material, whose thickness and width substantially precludes sidewise flexibility, will serve very well.

The normally upper end of such length 15 is attached to container lid 11 directly above the space between keeper members 13, with such connector length 15 passing downwardly through such space, while the normally lower end thereof is attached to the midpoint of bar latching member 14.

In the upright standing condition of container 10, bar latching member 14 is placed directly under the pair of keeper members 13 by reason of the force of gravity acting thereon. Flexible connector length 15 is sufficiently long to provide leeway for bar latching member 14 to easily swing under the pair of keeper members 13, see FIG. 3. As so placed relative to such keeper members, bar latching member 14 is pulled tightly into the recesses 13*a* of the keeper members if wind tends to raise container cover 11 or if the container is pushed over sideways or rearwardly, which are the usual directions of its being pushed. However, when the container is tipped in the dumping direction, gravity acting on the suspended latching member 14 will release such latching member from the keeper members.

Figure 6:
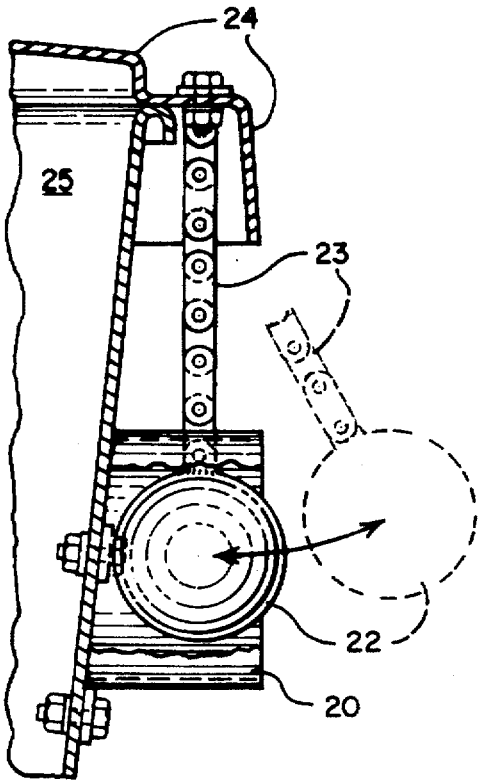
Figure 5:
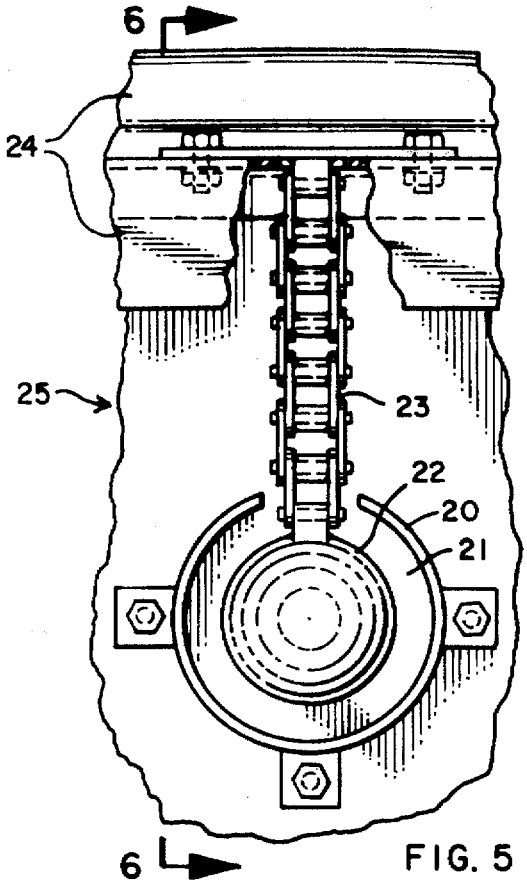

Although the embodiment of FIGS. 1–4 is preferred, FIGS. 5 and 6 show an embodiment wherein a single keeper member 20 is of ring formation whose internal diameter and entry opening 21 are capable of easily receiving a latching member 22, here in the form of a ball, attached to the normally lower end of a length 23 of flexible material here shown as similar to that of length 15. Keeper member 20 and opening 21 thereof are of sufficient diameter, and length 23 is sufficiently long, to permit ball latching member 22 to easily swing into such ring keeper member under the force of gravity, but the keeper ring internal diameter is such as to allow only limited upward movement of latching ball 22, so as to keep lid 24 of container 25 essentially closed even though lid 24 is blown upwardly or the container is blown or pushed over sidewardly or backwardly.

Figure 7:
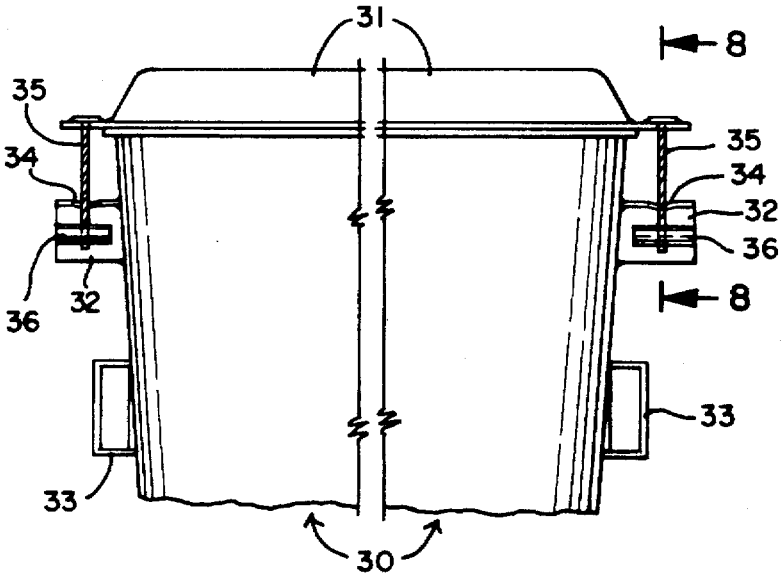
Figure 9:
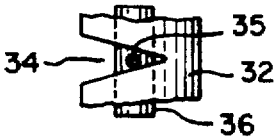
Figure 8:
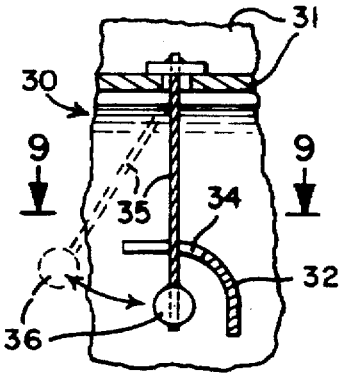

Another embodiment of latching means which may be used effectively for either the relatively small residential style containers or for the relatively large dumpster style containers is shown by FIGS. 7–9, wherein the container 30 is of dumpster style and a single keeper member 32 is provided at each of opposite sides of the container above respective fixtures 33 for receiving the arms of an automated garbage truck in the raising and tipping of the rubbish-receiving dumpster container 30. As with the foregoing embodiments of the invention, each keeper member 32 is secured to and extends outwardly from the container 30. Each of the single keeper members 32 projects outwardly from the container as an upwardly indented overhang with open bottom. Each is split along its length, preferably in V fashion, as at 34, from the forward end of such keeper member, so as to receive the length 35 of flexible material that interconnects container lid 31 with the latching member weight 36 here shown as of bar formation.

When container 30 is lifted and tipped forwardly by a conventional automated garbage truck, each latching member weight 36 is swung forwardly by gravity along the split 34 of the corresponding keeper member 32 to disengagement from its keeper member through the forward open end of the split.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A dumpable waste container for normally standing upright but adapted to be lifted and tilted toward and into dumping position by a waste collecting device carried by an automated garbage truck, said container comprising a hinged lid and automatic latching and unlatching means between said lid and the container, said means comprising at least one keeper member attached to said container, projecting outwardly therefrom, and being open for entry of a latching member, at least one latching member for entry into said keeper member, and at least one length of flexible material suspending a corresponding one of said at least one latching member from said lid so as to automatically enter a corresponding one of said at least one keeper member by gravity when the container is standing substantially upright and so as to automatically release said latching member by gravity when the container is lifted and tipped toward and into dumping position by said waste collecting device.

2. A dumpable container according to claim 1, wherein the said keeper member is made up of two mutually spaced apart keeper members; and the said latching member is an elongate bar adapted to span the space between the keeper members and to engage said spaced apart keeper members along its opposite end portions, respectively.

3. A dumpable container according to claim 1, wherein the said keeper member is of ring formation open in a forward direction and indented interiorly to receive and hold said latching member; and said latching member is of substantially ball formation adapted to enter the keeper member through its said opening and to engage its said indentation.

4. A dumpable container according to claim 1, wherein the length of flexible material attaching the said latching member to the container lid is sufficiently long to permit the lid to slightly move toward opening position but still maintaining the container lid closed until the container is moved into dumping position.

5. A dumpable container according to claim 1, wherein there is a said keeper member and a said latching member at each of opposite sides of the container.

6. A dumpable container according to claim 5, wherein the keeper member at each of the opposite sides of the container is elongate extending from front to rear of the container between the front of the container and lid-hinging means at the rear of the container, said keeper member overhanging the lower portion of the container when in its normal standing position and being slotted from the front end, which is open, toward the rear end, which is closed, for receiving the length of flexible material which connects said keeper member to the container lid.

* * * * *